US005518051A

United States Patent [19]

Wells

[11] Patent Number: 5,518,051

[45] Date of Patent: May 21, 1996

[54] ADAPTIVE HOLDER, EXTENSION HANDLE AND TOOTHBRUSH GUIDE FOR A TOOTHPASTE DISPENSER

[76] Inventor: Wesley W. Wells, 214 Enfield Falls Rd., Ithaca, N.Y. 14850

[21] Appl. No.: 60,603

[22] Filed: May 11, 1993

Related U.S. Application Data

[63] Continuation-in-part of Ser. No. 933,386, Aug. 21, 1992, abandoned.

[51] Int. Cl.[6] ..... B65B 1/04; B65B 3/00

[52] U.S. Cl. ..... 141/369; 141/368; 141/373; 141/114; 141/360; 222/162

[58] Field of Search ..... 222/162; 141/354, 141/357, 368, 369, 370, 373, 382, 391, 114, 360–362

[56] References Cited

U.S. PATENT DOCUMENTS

| | | | |
|---|---|---|---|
| 2,056,096 | 9/1936 | Etter | 141/370 |
| 2,558,272 | 6/1950 | Rubenstein et al. | 299/95 |
| 2,602,700 | 7/1952 | Ryan | 222/162 |
| 2,622,768 | 12/1952 | Hatcher | 141/373 |
| 2,851,066 | 9/1958 | Ott et al. | 141/370 |
| 2,941,700 | 12/1958 | Gable | 222/394 |
| 3,013,699 | 12/1961 | Meuwly | 222/174 |
| 3,100,065 | 8/1963 | Gross | 222/180 |
| 3,174,653 | 3/1965 | McEachran | 222/181 |
| 3,220,613 | 11/1965 | Palmer et al. | 222/174 |
| 3,286,883 | 11/1966 | Takiff | 222/173 |
| 3,405,843 | 10/1968 | Watson, Jr. | 222/162 |
| 3,750,913 | 8/1973 | Wild | 222/387 |
| 3,963,145 | 6/1976 | Fegley et al. | 222/162 |
| 4,570,829 | 2/1986 | Allen | 222/181 |

*Primary Examiner*—Henry J. Recla
*Assistant Examiner*—Steven O. Douglas
*Attorney, Agent, or Firm*—Barnard, Brown & Michaels

[57] ABSTRACT

An adaptive holder for a pump-style dispenser including a holder base and at least two converging side rails slanted from top to bottom and connected to the holder base. The dispenser base slides between and under the top of the converging side rails until it is secured to the holder base by frictional compression forces between the dispenser base, the converging side rails and the holder base. A toothbrush holder system for positioning a toothbrush in proximity to the dispenser is disclosed. A toothbrush holder base is secured in the adaptive holder along with the dispenser. The toothbrush is supported by support base and held in proper position by the side rails. As an alternative, the adaptive holder which includes a support rail can be provided with a toothbrush support base and toothbrush guide rails. The adaptive holder can be provided with support arms and an extension handle arm pivotally connected to the support arms. When the extension arm is depressed the pump actuator is also depressed. The extension arm can be adjustable to accommodate various sized dispensers and to dispense different amount of toothpaste. A nozzle closing plug can be located on the extension arm such that the extension arm can be pivoted to insert the closing plug into the nozzle. The adaptive holder can include a toothbrush support base connected to the extension arm.

3 Claims, 15 Drawing Sheets

Figure 18a
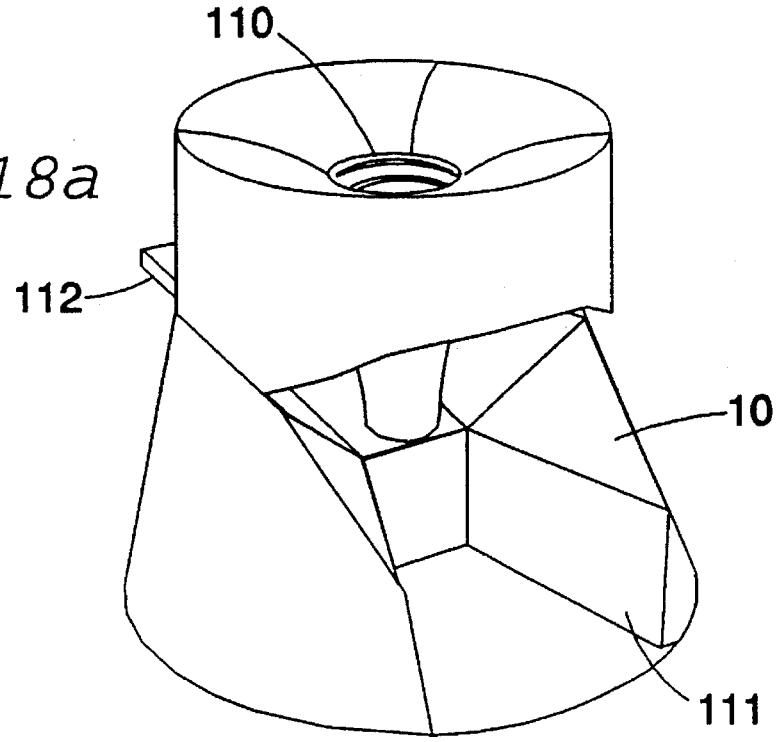
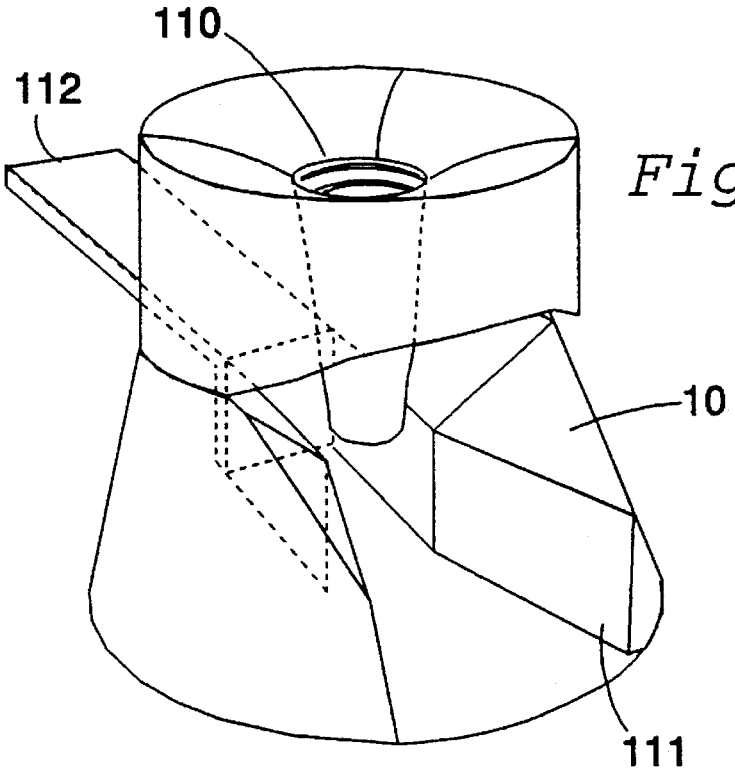
Figure 18b

ADAPTIVE HOLDER, EXTENSION HANDLE AND TOOTHBRUSH GUIDE FOR A TOOTHPASTE DISPENSER

CROSS-REFERENCE TO RELATED APPLICATIONS

This application is a continuation-in-part application of patent application Ser. No. 07/933,386, entitled "Adaptive Holder and Extension Handle for a Toothpaste Dispenser", filed Aug. 21, 1992.

FIELD OF THE INVENTION

The present invention relates to apparatus for adapting toothpaste dispensers for use by physically challenged individuals and more particularly relates to dispenser holders, adaptive handles and toothbrush guides.

BACKGROUND OF THE INVENTION

Physically challenged individuals often have a great deal of difficulty performing the daily tasks that most people take for granted. The lack of appropriately designed products and facilities often segregates these individuals from the rest of society. If adaptive devices can be provided to ease the burden of physical disabilities, life for physically challenged individuals can be more enjoyable. Furthermore, the expense of physical or occupational therapists and institutions can be reduced.

Physically and mentally handicapped individuals often have difficulty in brushing their teeth. This means that twice a day, a staff person in an institution must devote 15 to 30 minutes of individual attention to each patient merely to brush teeth. The pump-style toothpaste dispensers are used extensively in these institutions, because they automatically dispense an appropriate amount of toothpaste when the pump actuator is depressed. This helps reduce the mess generally left behind after a tube of toothpaste is used.

In the past different types of handles have been provided for spray containers such as those shown in U.S. Pat. No. 2,558,272 and U.S. Pat. No. 2,941,700, however, neither of these handles would be sturdy enough or easily securable on presently available pump-style toothpaste dispensers. U.S. Pat. Nos. 3,220,613, 3,100,065 and 3,013,699 each teach combined canister holders and spray can actuators. The canister holders shown in U.S. Pat. Nos. 3,013,699 and 3,220,613 each require tightening down wing nuts or screws to secure the canister, which is a relatively difficult task for an individual with arthritis or otherwise challenged. The holder taught in U.S. Pat. No. 3,100,065 shows a holder that is larger than the canister but does not show means for securing the canister within the holder such that the spray can actuator is in registry with the handle. Having to properly place the dispenser would make the task that much more difficult for mentally handicapped individuals. Furthermore, none of the aforementioned patent publications teach a handle that includes a nozzle plug for closing off the nozzle of the dispenser.

Heretofore, neither a holder or an extension handle for a pump-style toothpaste dispenser have been developed which allow physically challenged individuals to remove and insert the dispenser easily and quickly within the holder and use an extension handle to dispense toothpaste.

SUMMARY OF THE INVENTION

The primary object of the present invention is to provide a system for physically challenged individuals to independently dispense toothpaste and brush their teeth.

A further object of the present invention is to provide a holder for a pump-style toothpaste dispenser that allows for easy insertion and removal of the dispenser.

A further object of the present invention is to provide an extension handle for a pump-style toothpaste dispenser that allows the pump actuator to be easily depressed.

An adaptive holder for a pump-style dispenser is disclosed. The holder includes a holder base and at least two converging side rails slanted from top to bottom and connected to the holder base. The dispenser base slides between and under the top of the converging side rails until it is secured to the holder base by frictional compression forces between the dispenser base, the converging side rails and the holder base.

The converging side rails can be pivotally attached to the holder base. The distance between at one end of each of the side rails would be adjusted. A dispenser support rail attached to and extending perpendicular to the holder base for positioning and supporting the dispenser can be provided. The support rail can be adjustable in length.

A toothbrush holder system for positioning a toothbrush in proximity to the dispenser is disclosed. A toothbrush holder base is secured in the adaptive holder along with the dispenser. The toothbrush is supported by support base and held in proper position by the side rails. As an alternative, the adaptive holder which includes a support rail can be provided with a toothbrush support base and toothbrush guide rails.

The adaptive holder can be provided with support arms and an extension handle arm pivotally connected to the support arms. When the extension arm is depressed the pump actuator is also depressed. The extension arm can be adjustable to accommodate various sized dispensers and to dispense different amount of toothpaste. A nozzle closing plug can be located on the extension arm such that the extension arm can be pivoted to insert the closing plug into the nozzle. The adaptive holder can include a toothbrush support base connected to the extension arm. As the extension arm is depressed the support base slides between toothbrush guide rails and the toothbrush is supported by the toothbrush support base and moved into proper position to receive toothpaste as it is dispensed from the dispenser while the extension arm is depressed.

An adjustable dental apparatus support plate can be connected to the support rail. The plate can be raised and lowered to place the dental apparatus in proper position to receive the contents of the dispenser as they are dispensed.

An adaptive holder is provided for a toothpaste dispenser with a screw-on cap. A cylindrical threaded toothpaste dispenser attachment means is connected to the holder base. The attachment means screws on to the dispenser in place of the screw on cap. The toothbrush is held in proper position to receive toothpaste as it is dispensed from the dispenser by toothbrush guides in the holder base.

An adaptive holder is provided for supporting a pump-style dispenser in a perpendicular orientation with respect to a holder base by side panels. An actuation rail is connected to the holder base and abuts the pump actuator. When the dispenser is depressed the pump actuator is depressed. A support ann can connected to the holder base and so an extension handle arm can be pivotally connected to the support arm. When the arm is depressed the dispenser is depressed.

Further objects of the invention will be set forth in the description which follows, and become apparent to those skilled in the art upon examination of the specifications or by practice of the invention.

BRIEF DESCRIPTION OF THE DRAWINGS

FIGS. 18*a* and 18*b* are perspective views of a toothpaste dispenser holder that replaces a screw-on cap.

DETAILED DESCRIPTION

Figure 1:
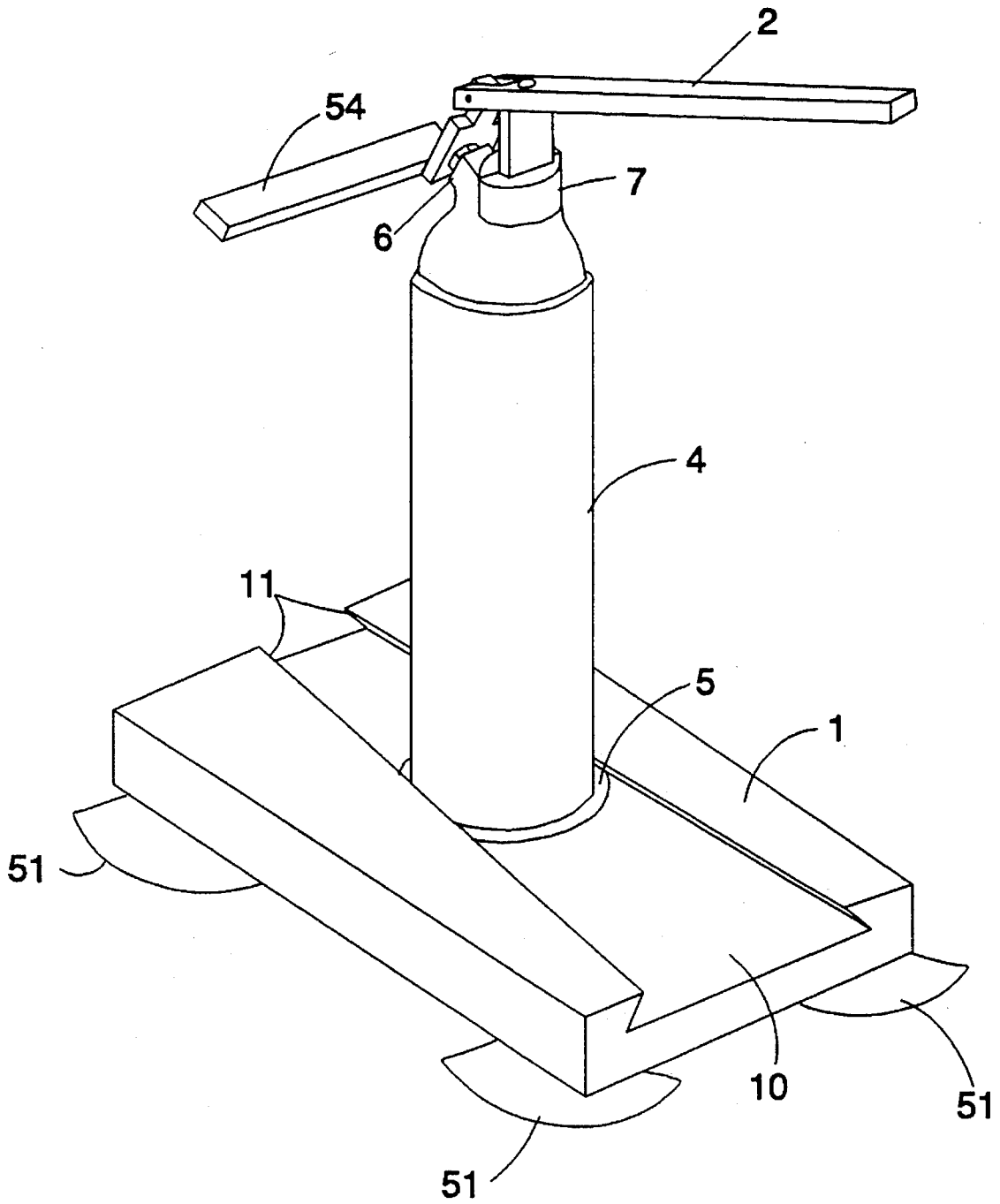
FIG. 1 is a perspective view of a converging rail type adaptive holder and a nozzle secured extension handle with a nozzle plug.

The present invention relates to method and apparatus for an adaptive holder and extension handle for pump-style toothpaste dispensers and the like. The method for adapting a toothpaste dispenser for use by a physically challenged individual comprises the following steps: securing an extension arm to the toothpaste dispenser such that when the arm is depressed the pump actuator is depressed; and securing the toothpaste dispenser in an adaptive holder such that the extension arm can be depressed and toothpaste can be dispensed through the nozzle onto a toothbrush while the toothpaste dispenser is secured.

Referring now to FIGS. 1 and 2*a*–2*c* a converging rail type adaptive holder 1 and a nozzle secured extension handle 2 with a nozzle plug are shown. The pump-style toothpaste dispenser 4 includes a dispenser base 5, a nozzle 6 through which toothpaste is dispensed and a pump actuator 7 for causing toothpaste to be dispensed. The holder 1 comprises a holder base 10 and at least two converging side rails 11 that are slanted and connected to the holder base 10 such that the dispenser base 5 is secured to the holder base 10 by frictional and compression forces between the dispenser base 5, the converging side rails 11 that are slanted and the holder base 10. The slanted side rails 11 exert a downward force as the dispenser 4 is inserted. The holder 1 can be used with a wide variety of pump-style dispensers and only requires one hand for insertion of the dispenser 4. This holder 1 is easy to use for both mentally handicapped and physically handicapped individuals in that it requires less small motor skills. Arthritis sufferers do not have to suffer the pain involved with tightening of bolts or other tedious means for securing a dispenser 4.

Figure 2A:
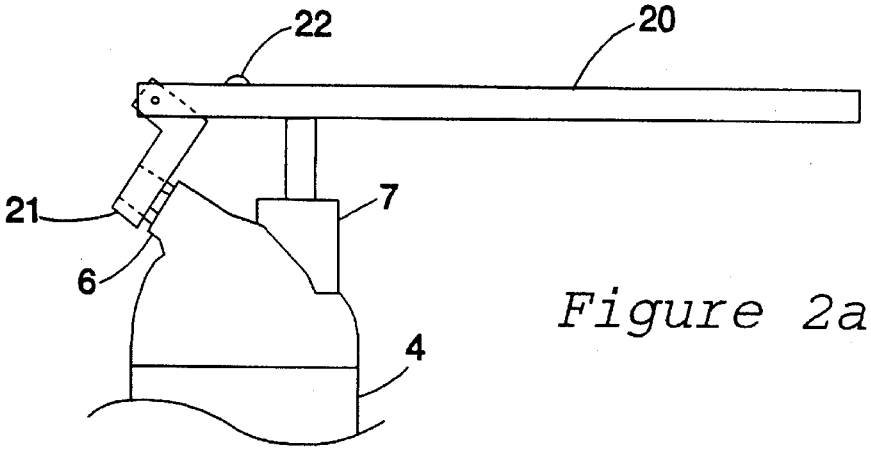
FIG. 2*a*, 2*b* and 2*c* are a side, top and detail view of a nozzle secured extension handle with a nozzle plug.
Figure 2B:
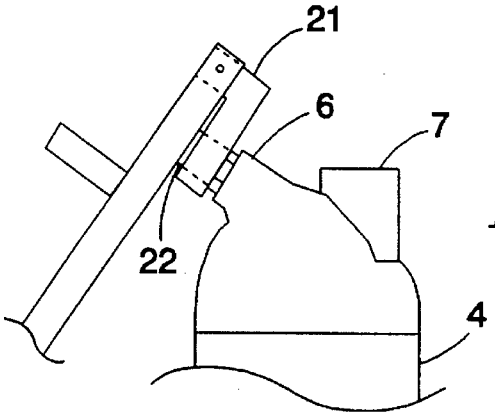
Figure 2C:
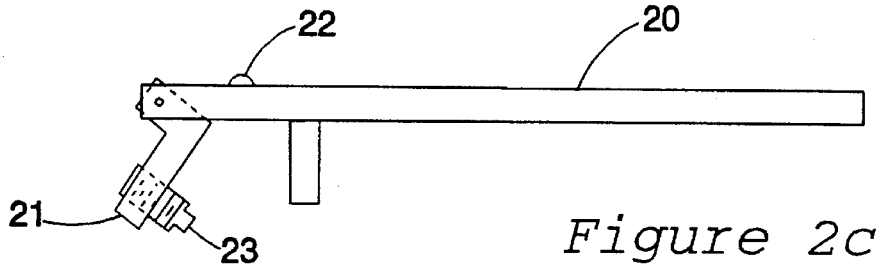

The adaptive extension handle 2 for a pump-style toothpaste dispenser 4 comprises an extension arm 20 and means for securing the extension arm 20 to the toothpaste dispenser 4 connected to the extension arm 20 such that when the arm 20 is depressed the pump actuator 7 is depressed. In FIG. 1 a nozzle securing means 21 is shown which is pivotally connected to the extension arm 20. A nozzle closing plug 22 is located on the extension arm 20 such that the extension arm 20 can be pivoted to insert the closing plug 22 into the nozzle 6. The nozzle securing means 21 can be threaded and either threaded on the inside or outside of the nozzle 6. Figure 2*c* shows a detail view of a threaded nozzle securing means 21 to be inserted on the inside of the nozzle 6. A non-threaded centering portion 23 is included for ease of installation. The toothpaste is dispensed through a hole in the nozzle securing means 21. Even though the narrower hole might be a little more constrictive to the flow of toothpaste, the added leverage given by the extension arm 20 makes any added constriction imperceptible.

This system would be easy to remove and replace, however, frequent removal of the extension handles 2 is not required. Once an extension handle 2 is placed upon an individual's toothpaste dispenser, it will remain there until the toothpaste is used up. In institutional type settings many patients or as little as two patients may share the same bathroom where it would be undesirable to leave individual toothpaste dispensers mounted for extended periods of time so they must be easy to remove and insert. Therefore the holder 1 has been designed for easy removal and insertion, whereas the extension handle has been designed for ease of use rather than ease of securing, however, some of the easier securing embodiments could easily be used by physically challenged individuals, namely the screw on base type extension handle.

Figure 3A:
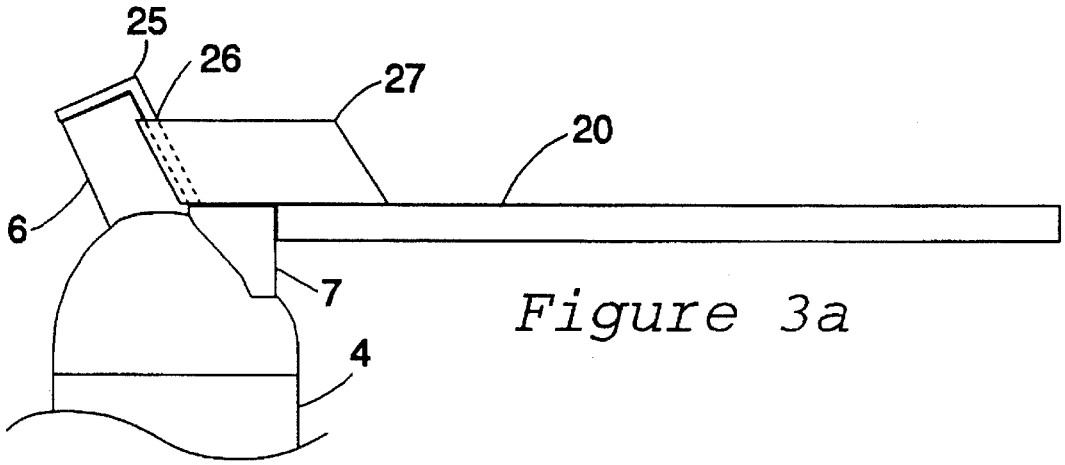
FIGS. 3*a* and 3*b* are a side and a top view of an adaptive extension handle secured to a nozzle closing device.
Figure 3B:
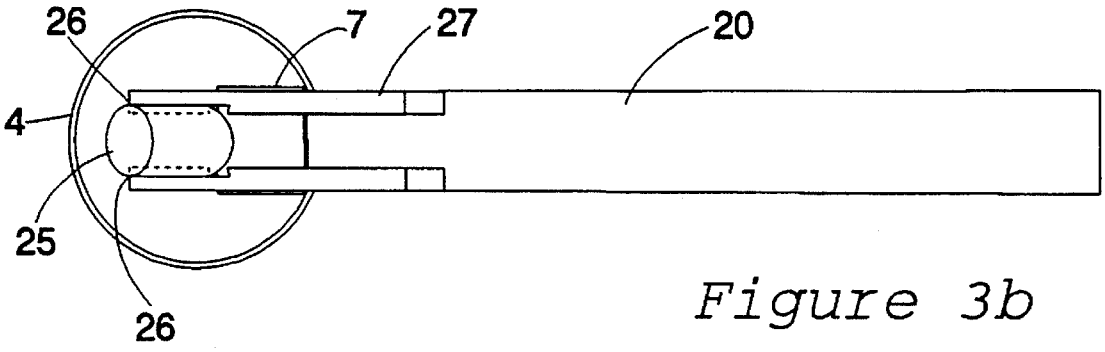

Some dispensers include a nozzle closing device 25. FIGS. 3*a* and 3*b* are a side and a top view of an adaptive extension handle 2 secured to a nozzle closing device 25. The adaptive extension handle 2 is secured by rails 26 connected to side panels 27 extending from the extension arm 20 such that the rails 26 engage the nozzle closing device 25 and secure the extension handle 2 as the extension arm 20 is depressed and the nozzle closing device 25 moves to open the nozzle 6. Additional rails could be added to the bottom of the extension arm 20 prevent the extension arm 20 from sliding from side to side on the pump actuator 7.

Figure 4A:
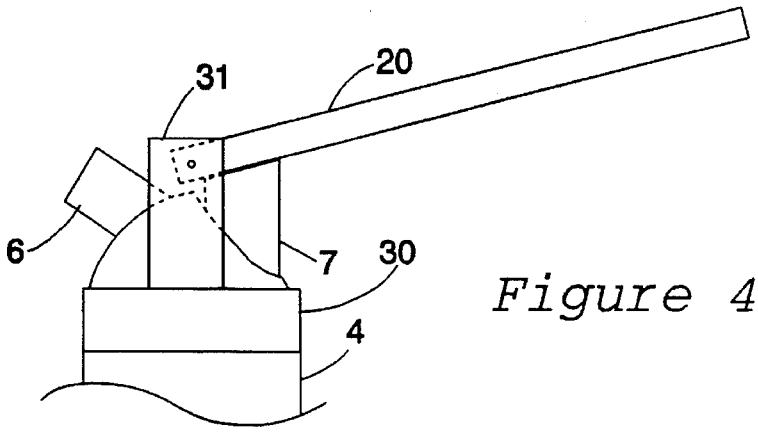
FIGS. 4*a* and 4*b* are a side and a top view of an adaptive extension handle secured by a screw on base with support arms.
Figure 4B:
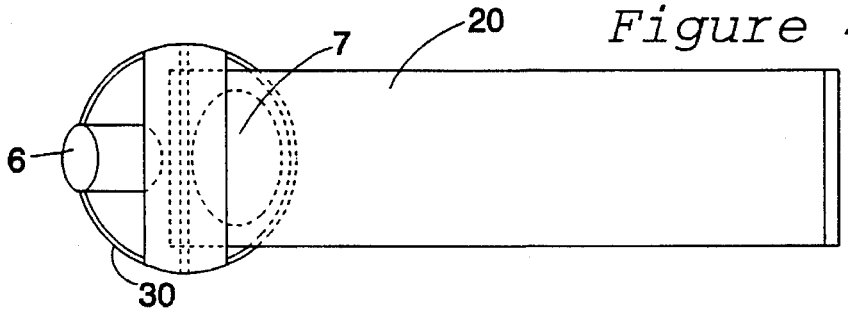

Most dispensers have screw on tops which could be replaced with a screw on extension handle 2. FIGS. 4*a* and 4*b* are a side and a top view of an adaptive extension handle 2 secured by a screw on base 30 with support arms 31. The means for securing the extension arm 20 comprises a screw on base 30 that screws on to the toothpaste dispenser in place of the screw on cap, and support arms 31 connected to the screw on base 30. The support arms 31 are pivotally connected to the extension arm 20 such that when the arm 20 is depressed the pump actuator 7 is depressed.

Figure 5A:
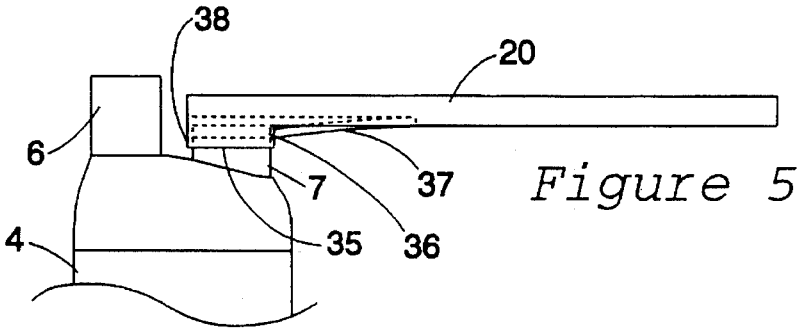
FIGS. 5*a*, 5*b* and 5*c* are a side, top and detail view of an adaptive extension handle secured to a cantilevering pump actuator by rails connected to the extension arm.
Figure 5B:
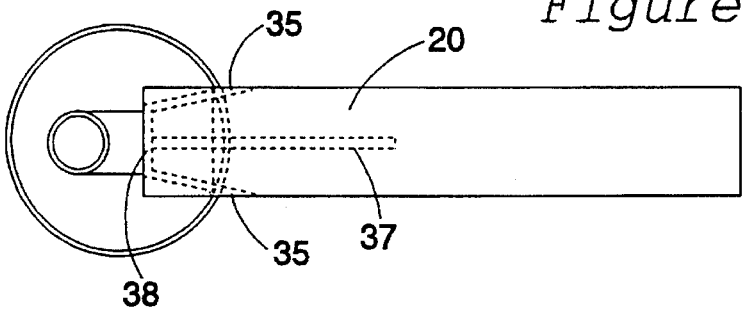
Figure 5C:
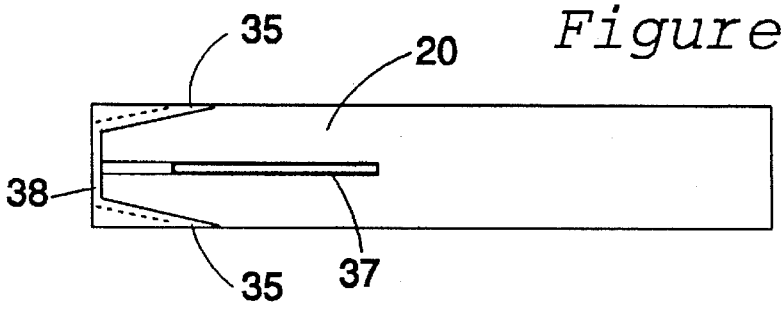

Some dispensers include a pump actuator that has a cantilevering top. FIGS. 5*a*, 5*b* and 5*c* are a side, top and detail view of an adaptive extension handle 2 secured to a cantilevering pump actuator 7 by rails 35 connected to the extension arm 20. The side rails 35 engage the cantilevering top portion 36 and secure the extension arm 20 as the extension arm 20 is depressed. A locking clip 37 and a back rail 38 can be located on the extension arm 20. The cantilevering top portion 36 slides between the side rails 35 until the back rail 38 is reached and the locking clip 37 temporarily locks the cantilevering top portion 36 within the rails 35 and 38.

Figure 6A:
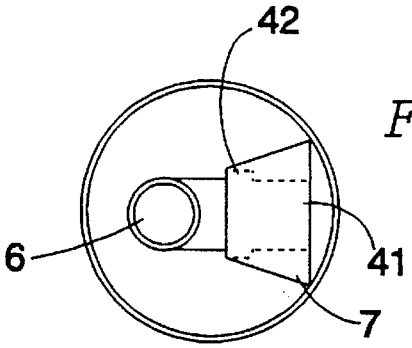
FIGS. 6*a* and 6*b* are a side and a top view of an adaptive extension handle secured by the engagement of a tab on the extension handle and a slot in the pump actuator.
Figure 6B:
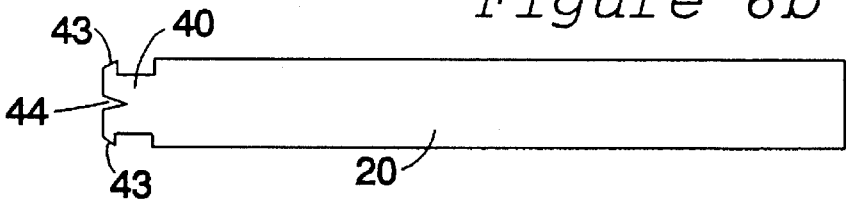

Currently, no pump style dispensers are sold together with an extension handle 2, however, an optional extension handle could easily be included in the manufacturing of such dispensers. FIGS. 6*a* and 6*b* are a side and a top view of an adaptive extension handle 2 secured by the engagement of a tab 40 on the extension arm 20 and a slot 41 in the pump actuator 7. The pump actuator 7 of the toothpaste dispenser 4 includes a slot 41 with a recessed portion 42 within the slot 41. The means for securing the extension arm 20 comprises a tab 40 with an extending portion 43 such that the tab 40 is inserted into the slot 41 until the extending portion 43 engages the recessed portion 42 thereby securing the extension arm 20. The tab 40 can include a slit 44 such that the tab 40 can be compressed as it is inserted into the slot 41 and, the compressed tab 40 releases as the extending portion 43 engages the recessed portion 42. Such an extension handle could easily be taped to the side of a toothpaste dispenser 4 in packaging. Any user who desired to use the handle 2 would merely insert it into the pump actuator 7. If a user did not opt to use the extension handle 2, he or she would discard it and the slot 41 would not interfere with the use of the dispenser 4 in any way.

Figure 7:
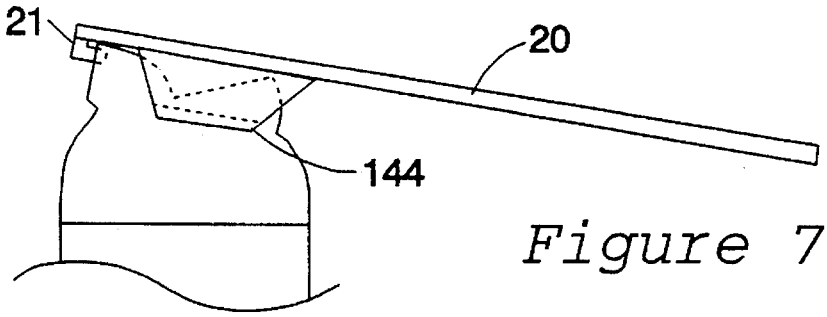
FIG. 7 is a side view of a nozzle secured extension handle with pump actuator guide rails connected to the extension arm.

FIG. 7 is a side view of a nozzle secured extension handle 2 with pump actuator guide rails 144 connected to the extension arm 20. The advantage of this design is that the nozzle securing means 21 would not constrict the flow of toothpaste. The guide rails 144 keep the extension arm 20 from moving from side to side.

Figure 8A:
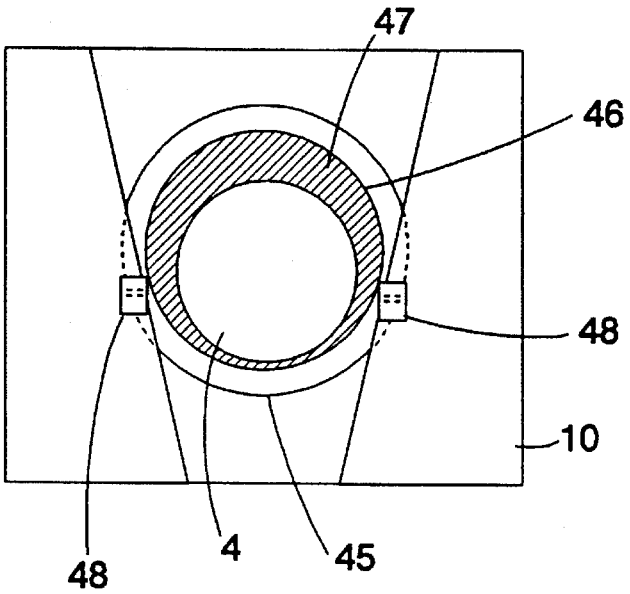
FIGS. 8*a* and 8*b* are a top view and a cross section of a tube type toothpaste dispenser holder.
Figure 8B:
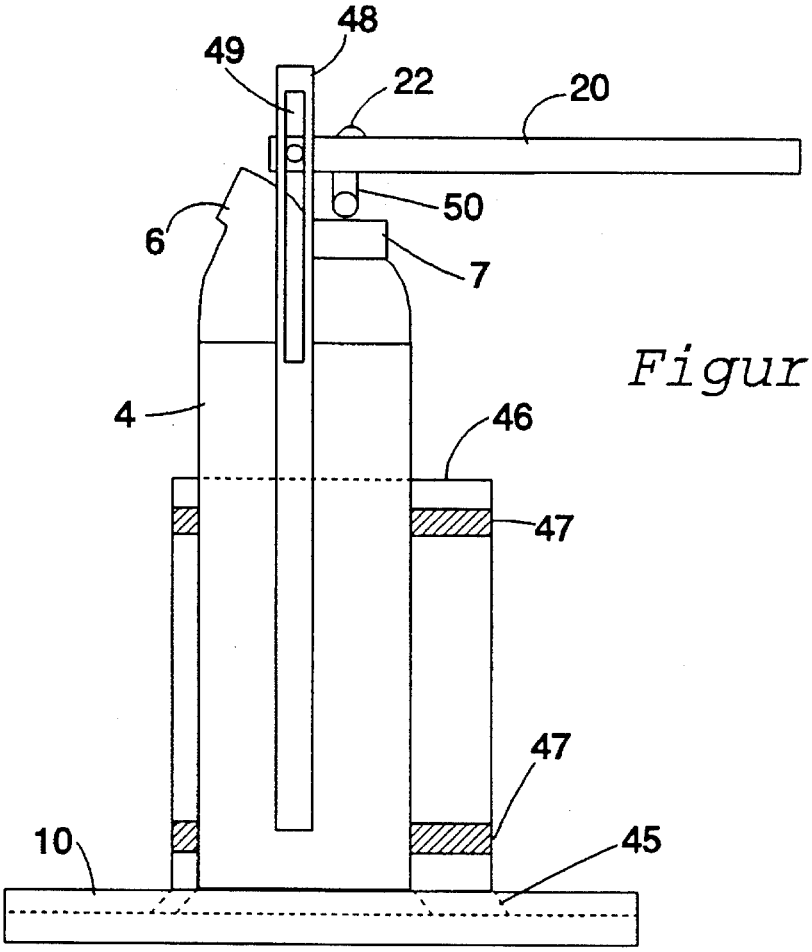

Another embodiment of a combined holder and handle unit is a tube type holder device. FIGS. 8*a* and 8*b* are a top view and a cross section of a tube type toothpaste dispenser holder 1. The holder 1 comprises a holder base 45, a holder tube 46 connected to the base 45 and at least one flexible washer 47. The holder tube 41 can be a large standard tube that fits into a converging rail holder base 10. The flexible washer 47 has an inside diameter that is equal to a diameter of the toothpaste dispenser and an outside diameter equal to an inside diameter of the holder tube 46 such that the flexible washer 47 secures the toothpaste dispenser 4 within the holder tube 46. The washers 47 could be left on the dispenser 4 and the dispenser/washer/tube combination could be removed and inserted in the holder 10 upon each use. The dispenser 4 could be offset within the washer 47 such that the same washer 47 could be used on a variety of dispensers 4. The washer 47 is twisted about the dispenser until the dispenser 4 is in proper position with the extension arm 4. The washer 47 could also be shaped to guide the dispenser into registry for an extension handle 2. The washer 47 is an important improvement over the dispenser apparatus shown in U.S. Pat. No. 3,100,065 in that the user does not have to worry about proper placement of the dispenser 4 once the washers 47 are positioned which would require skills often lacking in small children or mentally handicapped individuals. The user just points the dispenser 4 in the proper direction for use and it is automatically aligned. Two support arms 48 and an extension handle arm 20 pivotally connected to the support arms 48 can be included. When the arm 20 is depressed the pump actuator 7 is depressed. A nozzle closing plug 22 can be located on the extension handle arm 20 such that the extension handle arm 20 can be pivoted to insert the closing plug 22 into the nozzle 6. The support arms 48 could include slots 49 such that the pivot connection to the extension arm 20 is adjustable. A roller 50 could be included to facilitate easy dispensing of the toothpaste.

Figure 9:
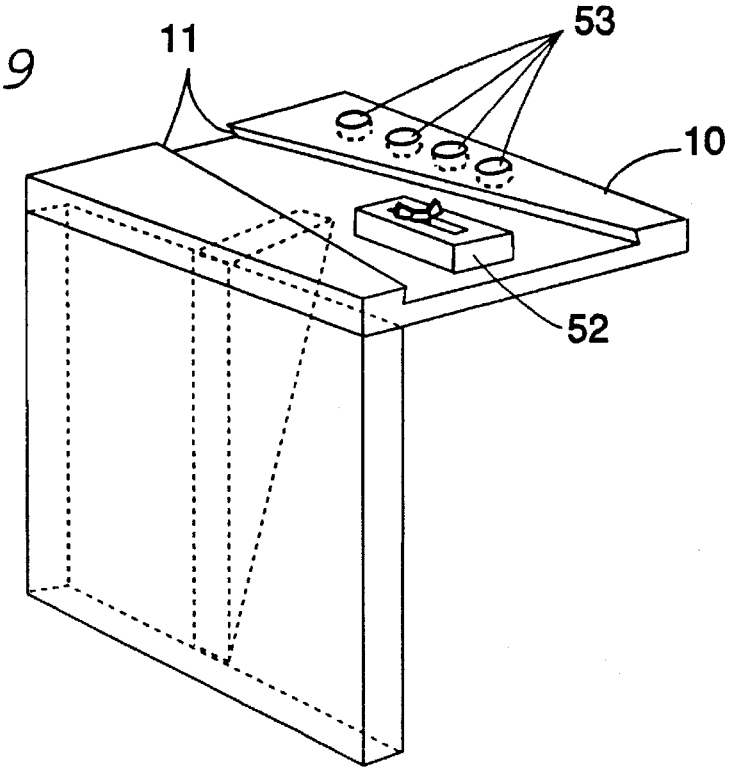
FIG. 9 perspective view of a wall mounted converging rail type holder with a locking device mounted onto a wall.

With the first embodiment of the holder 1, the proper placement occurs automatically as the dispenser is moved in the direction of the converging side rails 11. As shown in FIG. 1, a plurality of suction cups 51 are attached to the base 10. Any of the holders could be installed permanently if desired. FIG. 9 is wall mounted converging rail type holder 1 with a locking device 52 mounted onto a wall. A toothbrush holding rack 54 could be used for one-armed individuals. The dispenser 4 would be put in place and the toothpaste could be dispensed all merely by the use of one hand. The locking device 52 is shown merely to illustrate that the easy to use design of the holder 1 could be used in combination with a locking device 52 in a single user bathroom or a residential home. While the present invention is directed towards the physically challenged, individuals of normal physical ability can also benefit from the use of such a device. The holder 1 could also include holes 53 for keeping toothbrushes.

Figure 10:
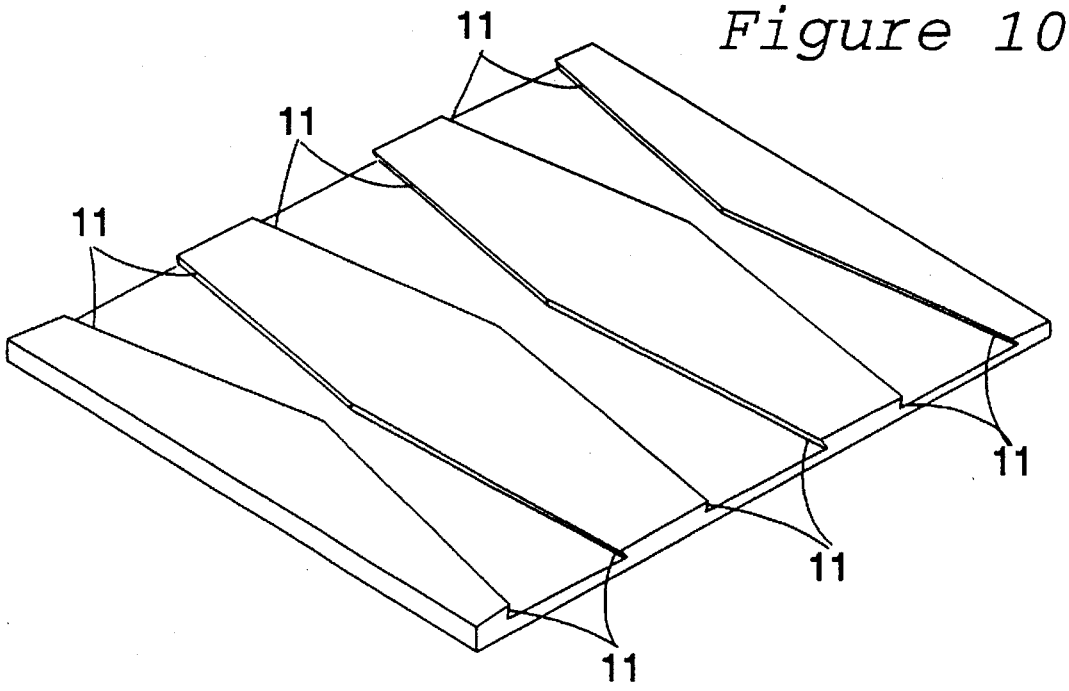
FIG. 10 is perspective view showing an efficient means for cutting material for a converging rail type holder.

FIG. 10 is an example of an efficient means for cutting material for a converging rail type holder 1. The rails 11 and base 10 could be formed out a single piece of material or separate pieces of materials. All of the pieces for the holders and extension handles taught herein could be made from injection molded plastic, metal or any other type of suitable material as chosen by one skilled in the art. The type of extension handle to be used would depend upon the needs of the individual and the type of toothpaste dispenser. However, the holder 1 and extension handle 2 shown in FIG. 1 are considered the best mode because of the ease of manufacturing, stability and ease of use.

Figure 11:
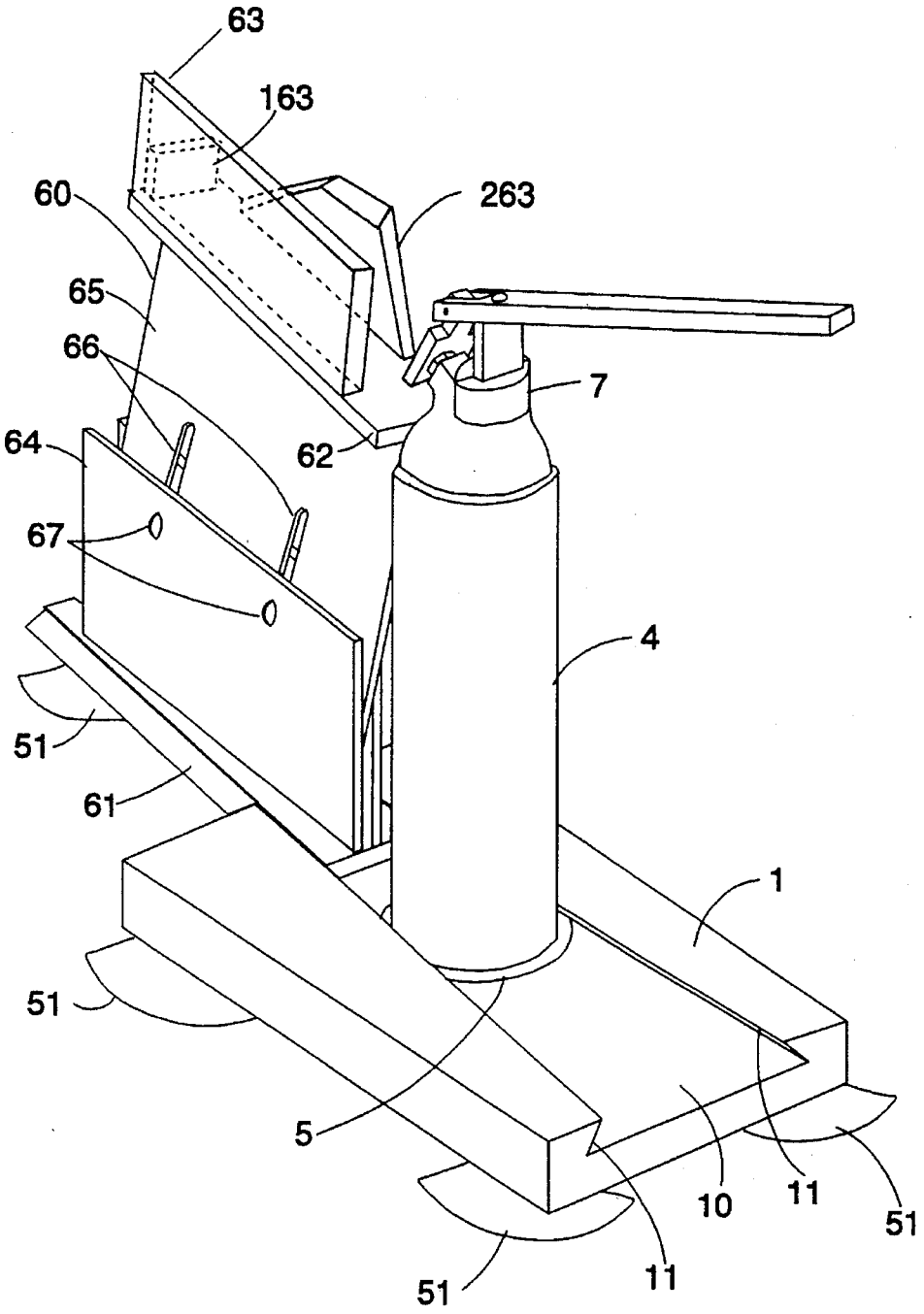
FIG. 11 is a perspective view of a toothbrush holder system being used in conjunction with a toothpaste dispenser holder.

FIG. 11 is a perspective view of a toothbrush holder system 60 being used in conjunction, with a toothpaste dispenser holder 1. A toothbrush holder base 61 is secured in the adaptive holder 1 along with the dispenser 4. A suction cup 51 can be provided on the toothbrush holder base 61. The toothbrush is supported by a support base 62 and held in proper position by the side rails 63, 163 and 263. The side rail 263 can be tapered to guide the brush into position. This is especially helpful to the blind as it provides a way to quickly orient the toothbrush. Furthermore, the height of the back side can be made to support the handle of an angled toothbrush while the head of the brush lies flat. Vertical support means are provided to connect the toothbrush support and the toothbrush holder base 61. As shown the vertical support means are provided by two bottom panels 64 connected to the base 61 with an upper panel 65 provided between the bottom panels 64. Slots 66 and screws 67 can secure the panels 64 and 65. The upper panel 65 can be adjusted to different angles and heights depending upon the type of dispenser and the needs of the user.

Figure 12A:
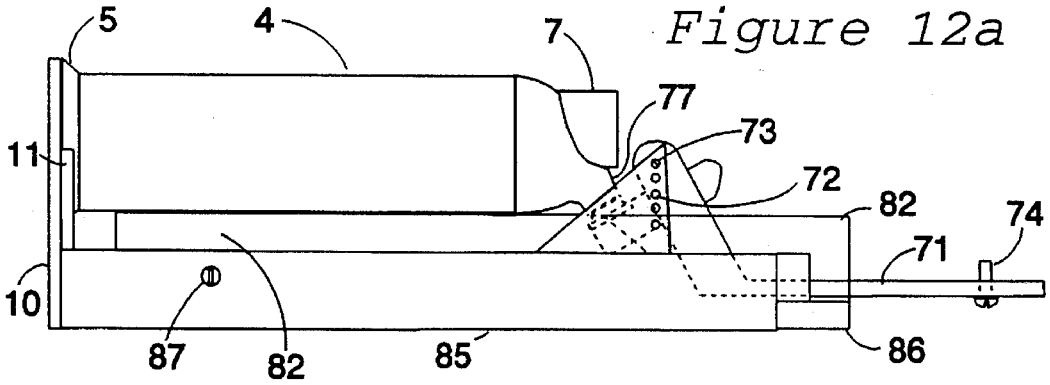
FIGS. 12*a*–12*c* are side views of a dispenser holder that holds a dispenser horizontally.
Figure 12B:
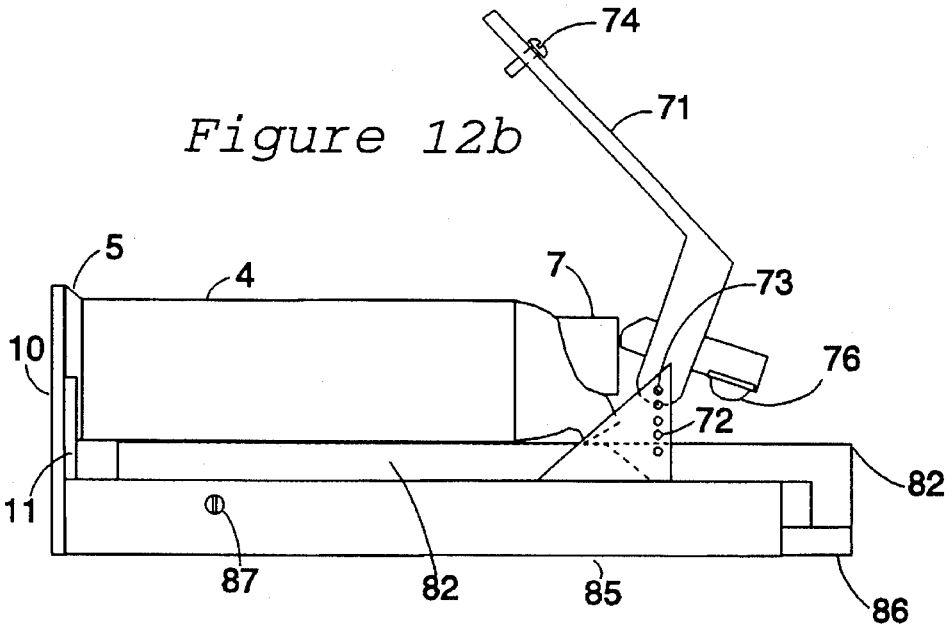
Figure 12C:
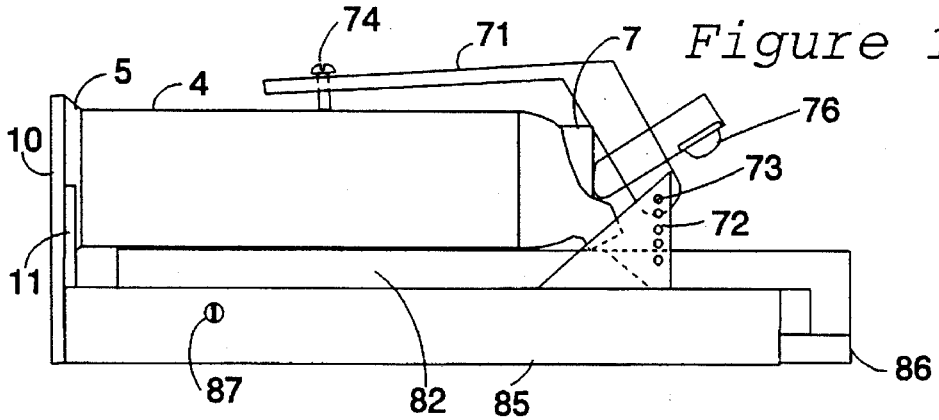

FIGS. 12*a–c* are side views of a toothpaste dispenser holder that holds a toothpaste dispenser 4 horizontally. The holder includes a holder base 10 and at least two converging side rails 11 slanted from top to bottom and connected to the holder base 10. The dispenser base 5 slides between and under the top of the converging side rails 11 until it is secured to the holder base 10 by frictional compression forces between the dispenser base 5, the converging side rails 11 and the holder base 10.

The adaptive holder can be provided with support arms 70 and an extension handle arm 71 pivotally connected to the support arms 70. When the extension arm 1 is depressed the pump actuator 7 is also depressed. The extension arm 71 can be adjustable to accommodate various sized dispensers 4 by attaching the extension arm 1 to the support arms 70 at various locations to provide different pivot points for various types of dispensers 4. As shown, holes 72 and a screw 73 are provided for connecting the extension arm 71 to the support arms 70. However, a continuously adjustable system could be provided instead by using slots as opposed to holes 72.

Figure 16A:
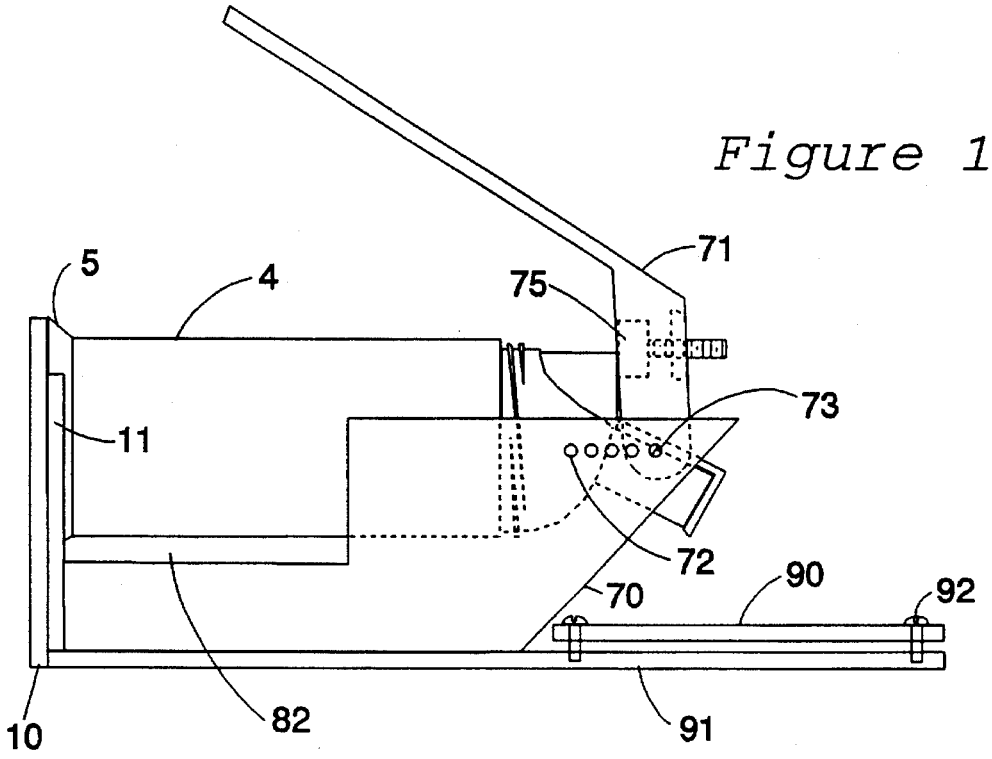
FIGS. 16*a* and 16*b* are side views of a dispenser holder that holds a dispenser horizontally with an adjustable dental apparatus plate.
Figure 16B:
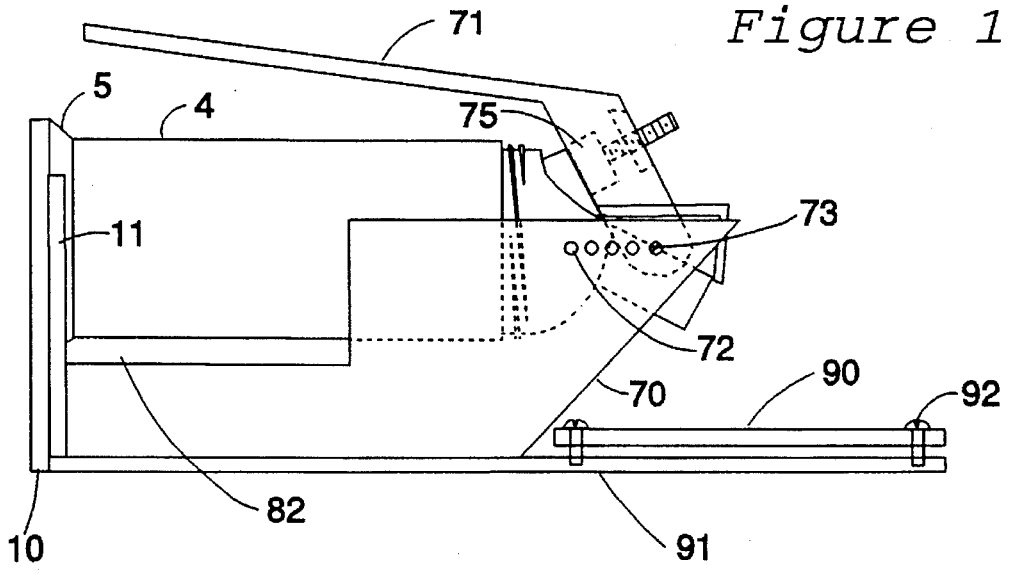

The extension arm 71 can include actuation adjustment means such that the amount the pump actuator is depressed varies depending upon the actuation adjustment means. This could be provided by a screw 74 in the extension arm 71 that contacts the dispenser 4 to prevent further depression of the extension arm 71, as shown in FIGS. 12*a–c*. This could also be provided by an adjustable abutment 75 that varies when the extension arm 71 first contacts the pump actuator 7 as shown in FIGS. 16*a* and 16*b*.

Figure 17:
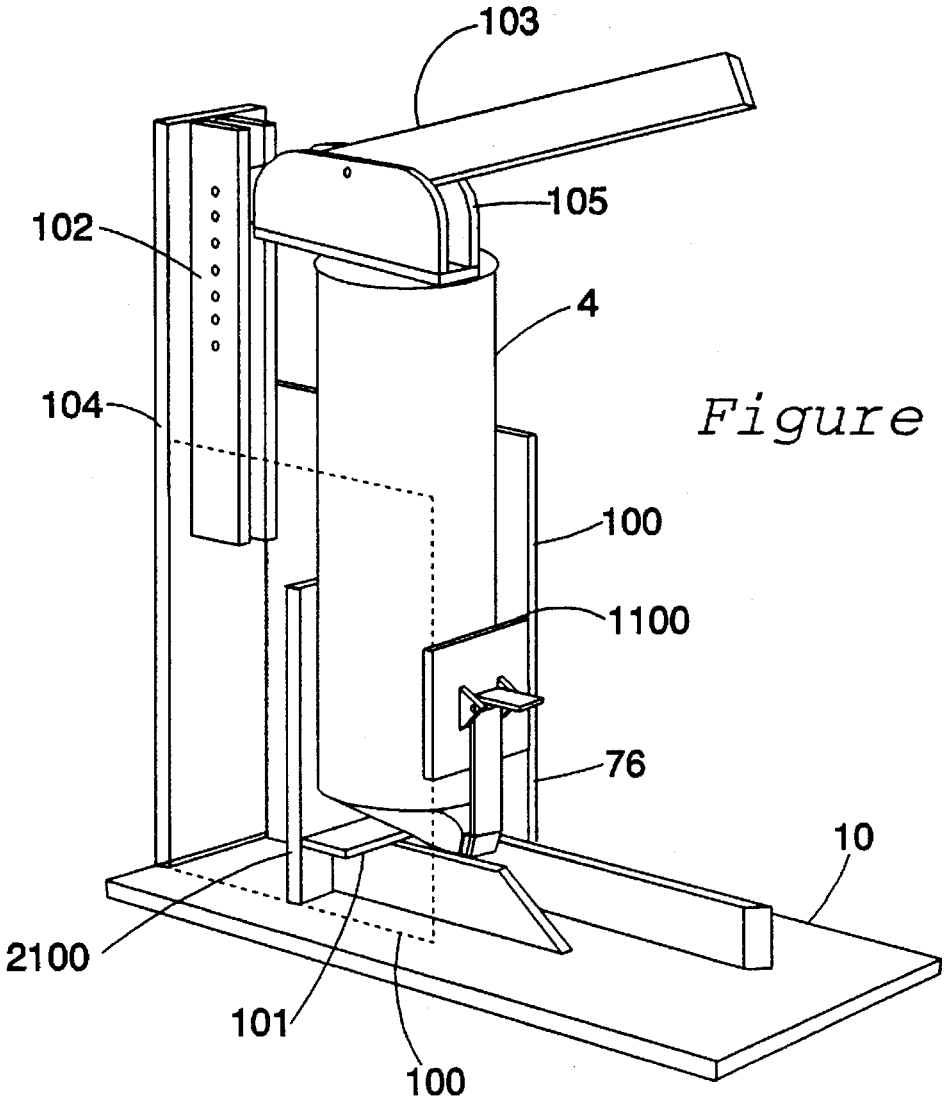
FIG. 17 is perspective view of a dispenser holder that holds a dispenser vertically.

A nozzle closing plug 76 can be located on the extension arm 71 such that the extension arm 71 can be pivoted to insert the closing plug 76 into the nozzle 77 of the dispenser 4 as shown in FIGS. 12*a–c*. A nozzle closing plug 76 could be attached elsewhere on the holder and flipped down when the dispenser 4 is not in use as shown in FIG. 17.

Figure 13:
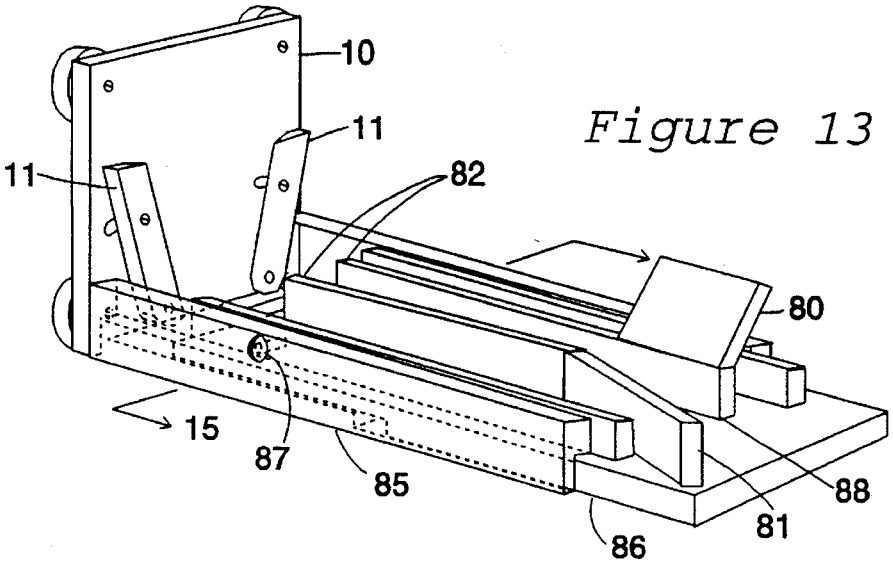
FIG. 13 is a perspective view of a dispenser holder that holds a dispenser horizontally with extended toothbrush guide rails, adjustable converging holder rails and adjustable dispenser support rails.
Figure 14:
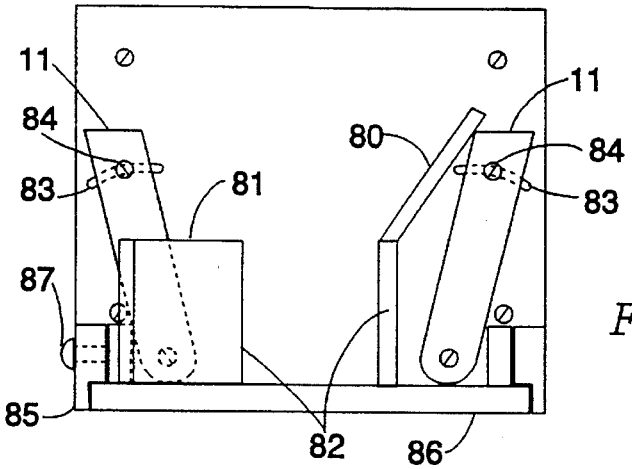
FIG. 14 is an end view of a dispenser holder that holds a dispenser horizontally with extended toothbrush guide rails, adjustable converging holder rails and adjustable dispenser support rails.

FIG. 13 is a perspective view of a toothpaste dispenser holder that holds a toothpaste dispenser 4 horizontally with extended toothbrush guide rails 80 and 81, adjustable converging holder rails 11 and adjustable dispenser support rails 82. Figure 14 is an end view of a toothpaste dispenser holder that holds a toothpaste dispenser 4 horizontally with extended toothbrush guide rails 80 and 81, adjustable converging holder rails 11 and adjustable dispenser support rails 82. At least one of the converging side rails 11 is pivotally attached to the holder base 10 such that the distance between at least one end of each of the side rails 11 can be adjusted. The slots 83 and screws 84 provide means for securing the pivotally attached side rails 11 in a selected position.

Figure 15:
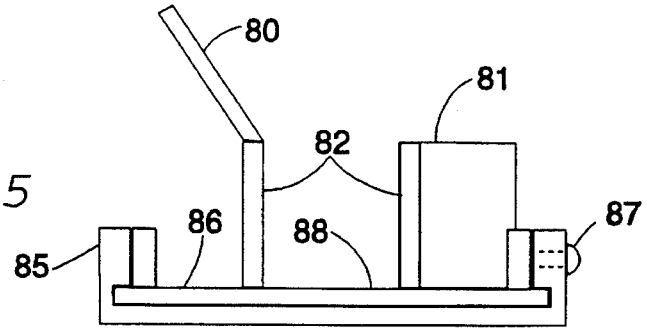
FIG. 15 is cut-away view of a dispenser holder that holds a dispenser horizontally with extended toothbrush guide rails, adjustable converging holder rails and adjustable dispenser support rails.

The adaptive holder has at least one dispenser support rail 82 (two shown) attached to and extending perpendicular to the holder base 10 for positioning and supporting the dispenser 4. As shown the support rails 82 can be attached to the holder base 10 by plates 85 and 86 which slide in and out as shown in FIG. 15. Plates 85 and 86 provide means for varying the distance between the end of the dispenser support rails 82 and the holder base 10 to accommodate dispensers 4 of varying lengths. Means for securing the support rails 82 in a selected position are provided by screw 87 which can secure the plates 85 and 86 by applying friction. If an extension arm 71 was provided on the holder shown in FIG. 13, the amount of toothpaste being dispensed could be controlled by moving plates 85 and 86.

Plate 86 can provide a toothbrush support base 88. A toothbrush is supported by the toothbrush support base 88 and held in proper position to receive toothpaste as it is dispensed from the dispenser by the toothbrush guide rails 80 and 81. The guide rail 80 is angled to guide a toothbrush into proper position from above and guide rail 81 is angled to guide a toothbrush into proper position from the end. Furthermore, a toothbrush stop plate could be included. The stop plate positions the toothbrush properly with respect to the nozzle of the dispenser. In the adjustable embodiments the stop plate would either move along with the plate 86 or be independently adjustable.

FIGS. 16*a* and 16*b* are side views of a dispenser holder that holds a dispenser 4 horizontally with an adjustable dental apparatus plate 90. The adjustable dental apparatus support plate 90 can be connected to the support rails 82 by plate 91. The plate 90 can be raised and lowered by screws 92 to place a dental apparatus, such as dentures, in proper position to receive the contents of the dispenser as they are dispensed. The dispenser 4 in FIGS. 16*a* and 16*b* is intentionally shown as a shorter than the dispensers in the other figures to demonstrate that the teachings of the present invention can be used with a variety of different sized dispensers. Typically, denture cream dispensers are shorter than toothpaste dispensers, so the shorter holders or an adjustable holder could be used to dispense denture cream onto dentures.

FIG. 17 is perspective view of a toothpaste dispenser holder that holds a toothpaste dispenser 4 vertically. The holder supports a pump-style dispenser 4 in a perpendicular orientation with respect to a holder base 10 by side panels 100, 1100 and 2100. An actuation rail 101 is connected to the holder base 10 and abuts the pump actuator 7. When the dispenser 4 is depressed the pump actuator 7 is depressed. A support arm 102 can connected to the holder base 10 and so an extension handle arm 103 can be pivotally connected to the support arm 102. As shown, the support arm 102 includes a plate 104 connecting it to the holder base 10. When the arm 103 is depressed the dispenser 4 is depressed. The extension arm 103 can include a pivoting dispenser abutment 105. A nozzle closing plug 76 can be attached to the side panel 1100.

FIGS. 18*a* and 18*b* are perspective views of a toothpaste dispenser holder that replaces a screw-on cap. A cylindrical threaded toothpaste dispenser attachment means 110 is connected to the holder base 10. The attachment means 110 screws on to the dispenser in place of the screw on cap. The toothbrush is held in proper position to receive toothpaste as it is dispensed from the dispenser by toothbrush guides 111 in the holder base 10. A closing plate 112 can be used to seal the nozzle to the toothbrush dispenser when not in use as shown in FIG. 18*a*.

Figure 19:
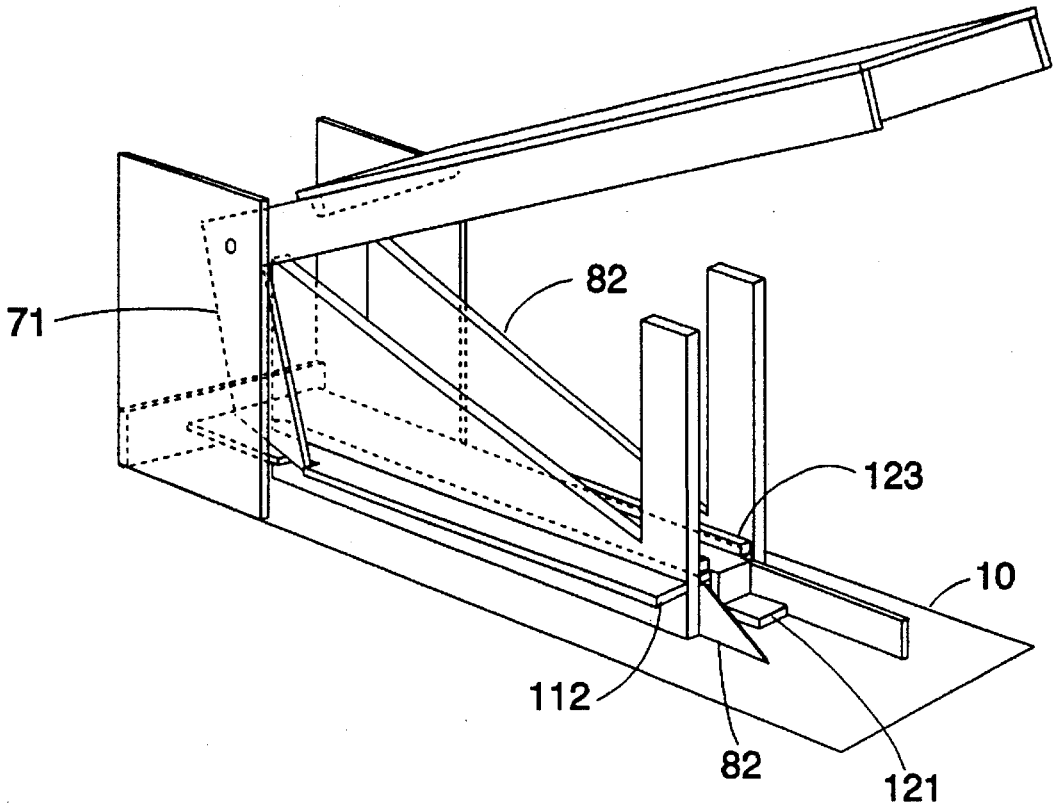
FIGS. 19 is a perspective view views of a toothpaste dispenser holder that includes a toothbrush support unit that moves the toothbrush into position to receive toothpaste.
Figure 20A:
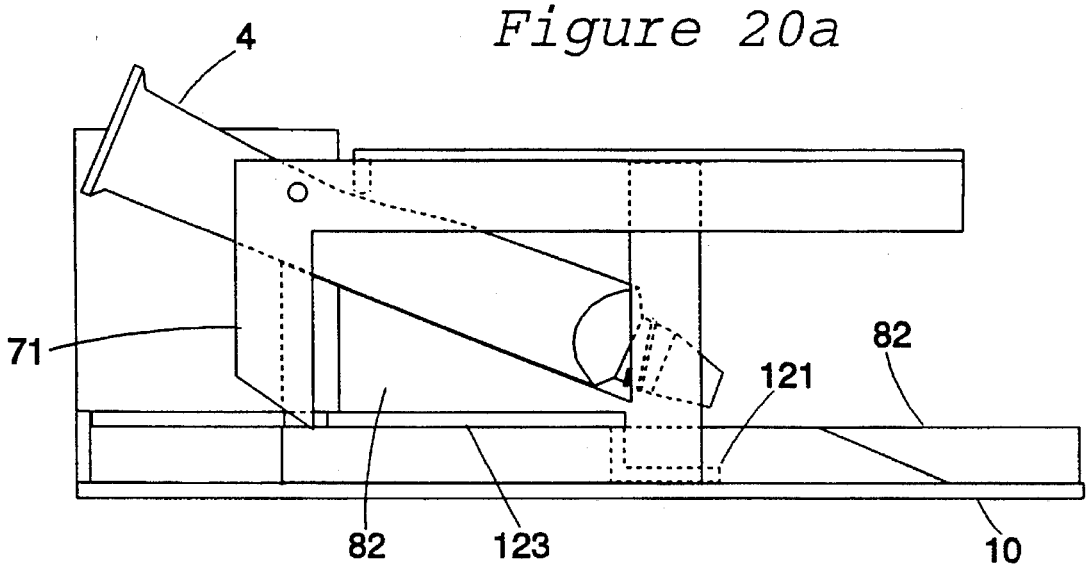
FIGS. 20*a* and 20*b* are side views of a toothbrush dispenser holder that includes a toothbrush support unit that moves the toothbrush into position to receive toothpaste.
Figure 20B:
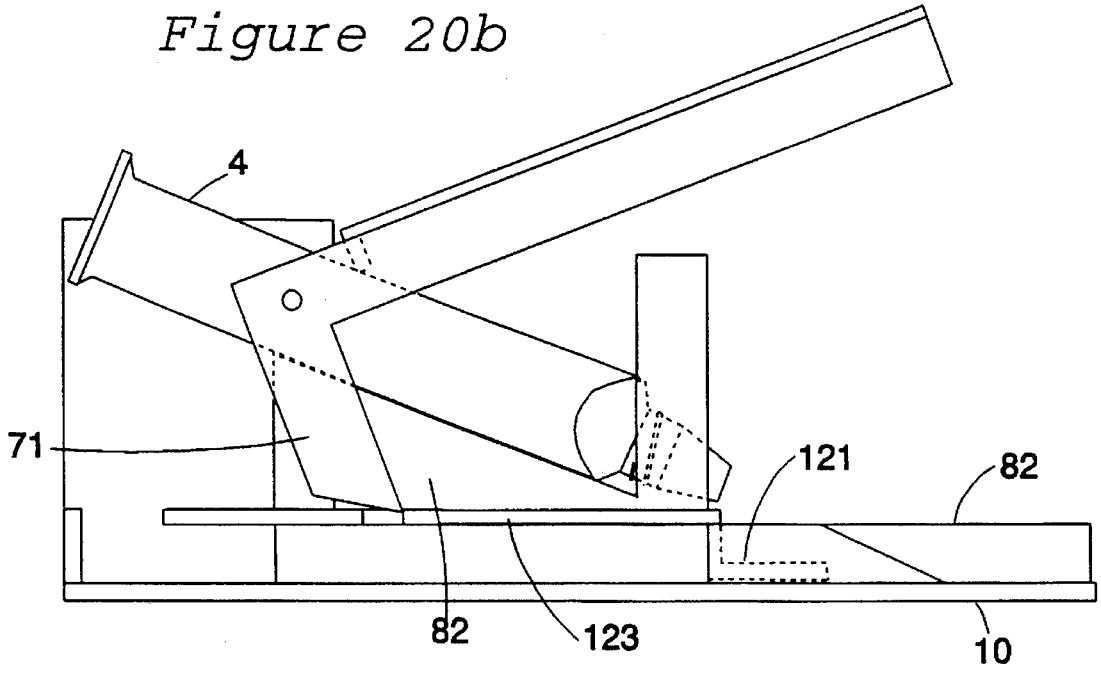

FIG. 19 is a perspective view and FIGS. 20*a* and 20*b* are side views of a toothpaste dispenser holder that includes a toothbrush support unit that moves the toothbrush into position to receive toothpaste. FIGS. 20*a* and 20*b* show a dispenser 4 that is actuated by compressing the sides of the dispenser 4. The extension arm 71 was provided appropriately. The toothbrush support base 121 is connected to the extension arm 71 by a plate 122. As the extension arm 71 is depressed the support base 121 slides between toothbrush guide rails 82 and the toothbrush is supported by the toothbrush support base 121 and moved into proper position to receive toothpaste as it is dispensed frown the dispenser 4 while the extension arm 71 is depressed. The plate 122 is held in position by rails 123. The toothbrush support could be provided the other embodiments disclosed herein as well. As shown, the toothbrush moves forward as the arm 71 is depressed, however, other connections between the arm 71 and the support base 121 could be provided such that the toothbrush moves backwards as the arm 71 is depressed.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

I claim:

1. An adaptive holder for a pump-style dispenser which includes a pump actuator, wherein said holder comprises:

a) a holder base;

b) side panels connected to said holder base adapted for supporting said dispenser in a perpendicular orientation with respect to said holder base;

c) a support arm connected to said holder base and an extension handle arm pivotally connected to said support arm such that said dispenser is depressed when said arm is depressed wherein said extension handle arm is attachable to said support arm at various locations to provide different pivot points for various types of dispensers;

d) an actuation rail connected to said holder base and adapted to abut said pump actuator when said dispenser is in said adaptive holder such that as said dispenser is depressed said pump actuator is depressed.

2. The adaptive holder of claim 1 further comprising toothbrush guide rails connected to said holder base for guiding a toothbrush into proper position to receive toothpaste as it is dispensed from said dispenser.

3. The adaptive holder claim 1 further comprising a nozzle closing plug pivotally connected to said panels such that said plug can be pivoted to insert into said nozzle.

* * * * *